United States Patent [19]

Ruppert et al.

[11] 4,441,881

[45] Apr. 10, 1984

[54] DETERGENT COMPOSITIONS CONTAINING ETHOXYLATED FATTY ALCOHOLS WITH NARROW ETHYLENE OXIDE DISTRIBUTIONS

[75] Inventors: Ronald M. Ruppert, Moonachie; Tamara Padron, Union City, both of N.J.

[73] Assignee: Lever Brothers Company, New York, N.Y.

[21] Appl. No.: 415,085

[22] Filed: Sep. 7, 1982

[51] Int. Cl.[3] ..... C11D 1/72; C11D 3/37; B08B 3/00

[52] U.S. Cl. ..... 8/137; 252/174.21; 252/174.22; 252/DIG. 1; 252/DIG. 15; 252/174.17; 427/393.4

[58] Field of Search ..... 252/174.17, DIG. 15, 252/DIG. 1, 174.21, 174.22; 427/393.4; 8/137

[56] References Cited

U.S. PATENT DOCUMENTS

| | | | |
|---|---|---|---|
| 3,682,849 | 8/1972 | Smith et al. | 260/615 B |
| 4,083,793 | 4/1978 | Jakobi et al. | 252/99 |
| 4,098,713 | 7/1978 | Jones | 252/89 |
| 4,100,094 | 7/1978 | Burns et al. | 252/174.17 |
| 4,138,352 | 2/1979 | Teot et al. | 252/174.17 |
| 4,210,764 | 7/1980 | Yang et al. | 568/618 |
| 4,223,163 | 9/1980 | Guilloty | 568/618 |
| 4,364,836 | 12/1982 | Ziche | 252/174.17 |
| 4,379,061 | 4/1983 | Rabitsch et al. | 252/174.17 |

FOREIGN PATENT DOCUMENTS

| | | |
|---|---|---|
| 33760 | 8/1981 | European Pat. Off. . |
| 1534641 | 12/1978 | United Kingdom . |

*Primary Examiner*—John E. Kittle
*Assistant Examiner*—Hoa Van Le
*Attorney, Agent, or Firm*—Milton L. Honig; James J. Farrell

[57] ABSTRACT

A detergent composition has been discovered that imparts improved soil shield properties to synthetic fabrics. The composition comprises:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution;

(b) an effective amount up to about 1.0% of a modified cellulose ether; and (c) the balance, detergency adjunct materials.

Plant tower smoke produced during the spray drying operation is reduced when using said composition with ethoxylated alcohols of narrow ethylene oxide distribution.

3 Claims, No Drawings

DETERGENT COMPOSITIONS CONTAINING ETHOXYLATED FATTY ALCOHOLS WITH NARROW ETHYLENE OXIDE DISTRIBUTIONS

BACKGROUND OF THE INVENTION 1. Field of the Invention

This invention relates to nonionic detergent compositions that provide an improved soil shield effect and exhibit reduced tower smoking during the detergent manufacturing process. More specifically, the invention concerns the use of nonionic surfactants of the ethoxylated $C_{12-18}$ fatty alcohol type having a narrow ethylene oxide distribution in combination with modified cellulose ethers for detergent compositions. 2. The Prior Art Condensation adducts of ethylene oxide with fatty alcohols have long been recognized as effective surfactants in detergent compositions. These adducts, a form of nonionic surfactant, are widely used in commerce.

Fatty alcohol ethoxylates are conventionally produced by reacting fatty alcohols with ethylene oxide in the presence of a catalyst. These reactions yield mixtures of alcohol derivatives with varying ethoxylate content. Individual components are rarely separated. Thus, what is commonly termed "an alcohol ethoxylate" is in reality a mixture of alcohol derivatives having a wide range of ethylene oxide units, including short chain adducts, as well as a certain proportion of unreacted alcohol. Moreover, the conventional designation of the number of ethylene oxide units present per molecule of an alcohol ethoxylate is actually a designation of the average weighted molecular distribution. There are substantial proportions of alcohol ethoxylate molecules present which have a greater or less number of ethylene oxide units than the actual average value would indicate.

Unreacted alcohol and short chain adducts are more volatile than the longer chain materials. Consequently, there is a tendency for these lower molecular weight compounds to be stripped from the main product during high temperature spray drying in detergent manufacturing. These volatiles then condense in the exhaust plume, as cooling occurs. Opaque droplets which result from the cooling reduce light transmission and comprise the "blue smoke" phenomena. Environmental regulations restrict the emission of "blue smoke". To overcome the problem, production rates of spray drying must be slowed to curtail smoking. Production capacity is accordingly lowered and operating costs are increased.

A second problem has been noted. Traditional broad ethylene oxide distributed alcohol ethoxylates in combination with modified cellulose ethers impart poor soil shield onto polyester and cotton/polyester fabrics. Soil shield is the protective coating of cellulosic deposited onto synthetic fabric during a wash in a detergent containing both a nonionic surfactant and a cellulose ether. Removal of oil and grease stains is facilitated in subsequent washes where fabrics have been soil shield treated.

A number of patents disclose efforts to improve the detergent activity and physical properties of alcohol ethoxylates by chemical modification. In U.S. Pat. No. 3,682,849, it was found that ethoxylate adducts derived from $C_{11-15}$ alcohols having 80% straight-chain structures and 20% 2-alkyl branched-chain structures, when stripped of unreacted alcohol and lower ethoxylates, exhibited lower pour points, lower melting points, higher cloud points, lower gel temperatures and better detergency than previous ethoxylates. Mixtures of compounds having different degrees of ethoxylation (where one alcohol is ethoxylated with 8 to 20 ethylene oxide units and a second contains 2 to 6 ethylene oxide units) were described in U.S. Pat. No. 4,083,793 as improved nonionic textile washing compositions. End capping of ethoxylated alcohols has been another chemical method of achieving improved properties. For example, U.S. Pat. No. 4,098,713 terminates an ethoxylated alcohol with a glycerine cap. Carboxyalkylation has been another popular method of capping alcohol ethoxylates. References to carboxyalkylation can be found in U.S. Pat. No. 4,223,163 assigned to Procter & Gamble. The P&G patent also outlines a process for making ethoxylated fatty alcohols with narrow polyethoxy chain distribution. Less than 5 moles of ethylene oxide per fatty alcohol are employed in the P&G carboxyalkylated ethoxylate.

While the aforementioned improvements in alcohol ethoxylates have benefited detergency and other physical properties of detergent compositions, none has successfully addressed the problem of poor soil shield toward polyester and cotton/polyester blend fabrics. The tower smoking problem has also not been solved.

SUMMARY OF THE INVENTION

It has now been discovered that an ethoxylated $C_{12-18}$ fatty alcohol having a narrow ethylene oxide distribution can significantly improve soil shield and also reduce tower smoking. Ethoxylated alcohols with a narrow ethylene oxide distribution in combination with modified cellulose ether and detergency adjunct materials are found to be exceptionally effective detergent compositions for cleaning semi-synthetic and synthetic fabrics.

In accordance with this invention, a detergent composition is provided having improved soil shield and reduced tower smoking properties comprising:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution;

(b) an effective amount up to about 1.0% of a modified cellulose ether; and (c) the balance, detergency adjunct materials.

A method for imparting a soil shield to semi-synthetic and synthetic fabrics is disclosed comprising washing said fabrics one or more times with a detergent composition comprising:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution;

(b) an effective amount up to about 1.0% of a modified cellulose ether; and (c) the balance, detergency adjunct materials.

Furthermore, a method of imparting soil shield characteristics to a detergent composition is disclosed by incorporating:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution;

(b) an effective amount up to about 1.0% of a modified cellulose ether; and (c) the balance, detergency adjunct materials.

Finally, a process for the spray dry manufacture of a detergent composition has been discovered wherein tower smoke is reduced comprising:

(i) forming an aqueous mixture containing:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution further characterized by exhibiting a smoke point of 321° F. or higher;

(b) an effective amount up to about 1.0% of a modified cellulose ether;

(c) the balance, detergency adjunct materials; and (ii) spray drying said mixture to produce a deterent powder.

DETAILED DESCRIPTION OF THE INVENTION

"Narrow ethylene oxide distribution" means that at least 50% by weight of the surfactant, preferably 60% or greater, contains polyethoxy groups which are within about 3 ethoxy groups of the average number of ethylene oxide units. However, it is highly desirable that no more than 70% of the polyoxyethylene groups have the same length since to provide very pure materials for detergent compositions is economically unfeasible. "Narrow ethylene oxide distribution" is further defined by the requirement that less than 5% of the ethoxylate mixture comprises short chain ethoxylates. Adducts containing six or less ethylene oxide molecules per alcohol molecule are considered to be short chain ethoxylates.

Alcohol ethoxylates of the present invention are synthesized by reacting 10 to 14 moles, and more preferably 11.5 to 12.5 moles, of ethylene oxide with a $C_{12-18}$ fatty alcohol in the presence of a catalyst. One method of preparing such ethoxylates is described in U.S. Pat. No. 4,210,764 and European Patent application No. 33,760. These patents are incorporated into the present application by reference. Barium or strontium oxides or hydroxides are employed therein as the ethoxylation catalyst together with promoters, chosen from a variety of phenols, carboxylic acids, amines, aldehydes, polyols, ketones, amides, or alcohols. Narrow distributions of ethylene oxide adducts are formed which greatly reduce the amount of unreacted free alcohol and undesirable low ethoxylate adducts normally found in ethoxylation product distributions. Alcohol ethoxylates suitable for the present detergent composition invention should not be construed as limited to those prepared according to the aforementioned patents.

Linear or branched chain alkyl primary alcohols are the preferred alcohols for ethoxylation. Representative examples of such alcohols are listed in U.S. Pat. No. 4,210,764 at columns 4 and 5.

A number of commercially available ethoxylated alcohols containing narrow ethylene oxide distributions have been found to be effective in the present detergent compositions. Among the preferred surfactants are certain members of the "Alfonic" series of ethoxylates, a trademark of Conoco, Inc., such as Alfonic 1218-70L, Alfonic 1412-70L and Alfonic 1214-70L. Typical "Alfonic" alcohol distributions are listed in Table I. Representative ethylene oxide distributions are outlined in Table II.

TABLE I

| | Analysis of Alcohol Distribution | | | | | | |
|---|---|---|---|---|---|---|---|
| Nonionic | $C_{12}$ | $C_{14}$ | $C_{16}$ | $C_{18}$ | Free Alcohol (%) | E.O. (Wt %) | E.O. (%) |
| Alfonic 1218-70 | 26.3 | 28.3 | 21.5 | 23.9 | 1.4 | 70.0 | 11.8 |
| Alfonic 1218-70L | 21.1 | 26.6 | 18.3 | 34.0 | 0.21 | 66.5 | 10.7 |
| Alfonic 1214-70L | 56.0 | 44.0 | — | — | 0.3 | 72 | 11.7 |
| Alfonic 1412-70L | 29.2 | 70.8 | — | — | 0.3 | 72 | 11.9 |

TABLE II

| | Analysis of Ethylene Oxide Distribution (Weight % Composition) | | | |
|---|---|---|---|---|
| Moles E.O. | 1218-70 Conventional Nonionic | 1218-70L | 1214-70L | 1412-70L |
| 0 | 1.50 | 0.20 | 0.30 | 0.20 |
| 1 | 1.00 | 0 | 0.27 | 0.17 |
| 2 | 1.75 | 0.15 | 0.20 | 0.14 |
| 3 | 2.00 | 0.25 | 0.37 | 0.38 |
| 4 | 3.30 | 0.30 | 0.74 | 0.38 |
| 5 | 3.25 | 0.50 | 0.94 | 0.60 |
| 6 | 3.85 | 1.75 | 1.79 | 1.10 |
| 7 | 4.60 | 2.15 | 2.76 | 2.05 |
| 8 | 5.50 | 4.15 | 4.23 | 3.40 |
| 9 | 6.75 | 6.50 | 6.03 | 5.07 |
| 10 | 7.75 | 8.25 | 8.18 | 7.22 |
| 11 | 8.00 | 10.10 | 10.22 | 9.14 |
| 12 | 8.00 | 11.50 | 11.61 | 10.60 |
| 13 | 7.90 | 11.90 | 12.38 | 11.70 |
| 14 | 7.50 | 11.00 | 11.57 | 10.49 |
| 15 | 6.80 | 9.80 | 10.02 | 9.38 |
| 16 | 6.00 | 7.75 | 7.79 | 8.14 |
| 17 | 5.00 | 5.70 | 5.71 | 6.54 |
| 18 | 4.00 | 4.00 | 3.34 | 5.13 |
| 19 | 3.00 | 2.50 | 1.53 | 3.68 |
| 20 | 2.00 | 1.00 | — | 2.55 |
| 21 | — | — | — | 1.94 |
| Avg. E.O. | 11.0 | 11.5 | 11.6 | 12.5 |

Alfonic 1218-70, is a conventional ethoxylated $C_{12-18}$ alcohol mixture containing an average of about 11 to 12 ethylene oxide units and having about 70 weight % ethylene oxide in the total adduct. Narrow ethylene oxide distributions are illustrated in the commercial surfactants Alfonic 1218-70L, Alfonic 1214-70L and Alfonic 1412-70L. As seen from Table I, the Alfonic "L" adducts, although of similar ethoxylation levels, contain smaller amounts of free alcohol (0.3% or less). Furthermore, as seen in Table II, the Alfonic "L" narrow ethylene oxide distribution adducts have considerably less than 5% of their mixture containing short chain (six molecules or less ethylene oxide per chain) alcohol adduct. In comparison, the traditional alcohol ethoxylate as represented by Alfonic 1218-70 contains higher amounts of free alcohol (1.4%) and more than 5% of the short chain ethoxylated alcohol adducts.

Besides the nonionic surfactant, the detergent compositions of this invention contain modified cellulose ethers. Soil shield effects derive primarily from the interaction of the narrow ethylene oxide distributed alcohol ethoxylates with modified cellulose ethers. In addition, there are a number of detergent adjunct materials necessary in the detergent compositions of this invention. Adjuncts include detergency builders, soap and minor ingredients such as fluorescent dyes, colorants, and perfumes.

MODIFIED CELLULOSE ETHERS

Detergent compositions frequently contain soil release agents. They effectively and efficiently deposit from the wash solution onto fabrics. When the fabrics are subsequently soiled and washed, the presence of the previously deposited cellulose ether film allows the soil to be more easily removed.

Cellulose ethers are a well known class of materials. Those useful in the present invention are generally derived from vegetable tissues and fibers, including especially cotton and wood. The molecular weight of such cellulose ethers can vary from about 19,000 to about 185,000. The hydroxyl group of the anhydro glucose unit of cellulose can be reacted with various reagents thereby replacing the hydrogen of the hydroxyl with other chemical groups. Various alkylating and hydroxyalkylating agents can be reacted with cellulose materials to produce either alkyl, hydroxyalkyl, or hydroxyalkyl alkyl cellulose ethers or mixtures thereof useful in the present detergent compositions. The degree of substitution may vary up to 3.0 since there are three available positions on each anhydro glucose unit.

Among the modified cellulose ethers useful in the present detergent composition are hydroxyethyl methyl cellulose, hydroxypropyl methyl cellulose, hydroxybutyl methyl cellulose, hydroxyethyl ethyl cellulose, hydroxyethyl cellulose and methyl cellulose. Sodium carboxymethyl cellulose, a commercially significant antiredeposition agent, was found not to be an effective soil shield agent when used in combination with the nonionic surfactant of this invention. Especially preferred is hydroxypropyl methyl cellulose having a viscosity of 4,000 and a molecular weight of between 80,000 to 90,000. Commercially, the said preferred hydroxypropyl methyl cellulose can be obtained from the Dow Chemical Company sold under the trademark Methocel E-4M. More specifically, hydroxypropyl methyl cellulose is a cellulose with methoxyl groups and hydroxypropyl groups replacing approximately 60% and 10%, respectively, of the hydroxyl groups. The hydroxypropyl methyl cellulose and other modified cellulose ethers of this invention are employed in an effective amount up to about 1.0%. Preferably, the effective amount is about 0.05% to about 0.1% by weight of the total formulation.

Since deposition of the modified cellulose ether on synthetic fabrics is dependent upon its partitioning between the aqueous wash solution and fabric surface, the gel point of the modified cellulose ether should be within ±40° C. of the wash solution temperature.

SOAP

Soaps may also be present in the detergent compositions of this invention. The soaps which can be used are the watersoluble salts of $C_{10-20}$ fatty acids, in particular, with inorganic cations such as sodium and potassium. It is particularly preferred that the soaps should mainly contain the medium chain fatty acids within this range, that is, with at least half of the soaps having a carbon chain length of from $C_{10}$ to $C_{14}$. This is most conveniently accomplished by using soaps from natural sources such as coconut, nut or palm kernel oils, with lesser amounts of the longer chain soaps prepared from tallow, palm or rapeseed oils. Sodium coconut soap is an especially preferred embodiment of this invention. The amount of such soap can be about 0% to about 1.5% by weight of the total detergent composition. Amounts of soap between about 0.1 to about 1.0% are especially preferred.

DETERGENT BUILDERS

The detergent compositions of this invention can contain all manner of detergent builders commonly taught for use in detergent compositions. The useful builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, silicate, sesquicarbonate, borate and aluminosilicate.

An especially preferred builder is sodium silicate having a $Na_2O:SiO_2$ ratio of about 1:2.4, although the range of 1:2 to 1:3 is normally useful and often ratios as low as 1:3.2 are acceptable. Concentrations of sodium silicate may range from about 2 to about 35% by weight of the total detergent composition. Preferably, concentrations of about 4 to about 15% are employed in the compositions.

Sodium carbonate and sodium tripolyphosphate are still other preferred detergency builders. They can be employed either separately or as mixtures in the present compositions. The total concentration of sodium carbonate and sodium tripolyphosphate, alone or in combination, can range from about 10 to about 40% of the total weight of the detergent composition. Preferably, concentrations from about 20 to about 40% are employed in the detergent compositions of this invention.

Among the organic detergent builders that can be used in the present invention are the sodium and potassium salts of the following: citrate, amino polycarboxylate, nitrilotriacetates, N-(2-hydroxyethyl)-nitrilodiacetates, ethylene diamine tetraacetates, hydroxyethylenediamine tetraacetates, diethylenetriamino pentaacetates, dihydroxyethyl glycine, phytates, polyphosphonates, oxydisuccinates, oxydiacetates, carboxymethyloxysuccinates, hydrofuran tetracarboxylates, ester linked carboxylate derivatives of polysaccharides such as the sodium and potassium starch maleates, cellulose phthalates, glycogen succinates, semi-cellulose diglycolates, starch and oxidized heteropolymeric polysaccharides. The foregoing is meant to illustrate but not limit the types of builders that can be employed in the present invention.

MINOR COMPONENTS

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the monoethanolamides derived from palm kernel fatty acids and coconut fatty acids; lather depressants, such as alkyl phosphates, waxes and silicones; oxygen-releasing bleaching agents, such as sodium perborate and sodium percarbonate; per-acid bleach precursors; chlorine-releasing bleaching agents, such as trichloroisocyanuric acid and alkali metal salts of dichloroisocyanuric acid; fabric softening agents; inorganic salts, such as sodium sulphate and magnesium silicate; and usually present in very minor amounts, fluorescent agents, perfumes, enzymes, germicides and colorants.

Among the fillers that are useful for the present invention, sodium sulfate has been found to be a preferable material, concentrations of about 30% to about 50% by weight of the detergent composition can be usefully employed. Sodium sulfate concentrations of about 40 to about 46% have been found especially preferable in the present invention.

Small amounts of fluorescent brightener dyes generally ranging from about 0.01 to about 0.15% by weight of the total detergent composition are found in the present invention. For example, Tinopal RBS-200 (sulfonated stilbene benzotriazole) and Tinopal AMS (sodium 4,4'-bis(2-phenolamino-4-morpholino-1,3,5, triazyl(6-)diaminostilbene-2,2'-disulfonate), trademarks of Ciba-Geigy Corporation, were found to be especially useful in the present detergent compositions. Tinopal AMS is preferably used in a concentration of about 0.04 to about 0.13% and Tinopal RBS-200 is preferably used at about 0.02 to about 0.05% by weight.

Certain clays may also be present as emulsification and processing aids. Among the preferred clays are diatomaceous earth and dicalite (natural alumino silicate-perlite). These clays can be present in an amount at about 0% to about 2.5%.

The following examples will more fully illustrate the embodiments of this invention. All parts, percentages and proportions referred to herein and in the appended claims are by weight unless otherwise indicated.

EXAMPLE 1

This example illustrates the use of a $C_{12-14}$ fatty alcohol ethoxylate of narrow ethylene oxide distribution (Alfonic 1412-70L) in combination with hydroxypropyl methyl cellulose with both phosphate and non-phosphate formulations. In preparing these detergent powders, the components, other than nonionic surfactant, were spray dried together. Subsequently, the nonionic surfactant Alfonic 1218-70L was applied to the mixture in a post-dose treatment. In post-dosing, the nonionic surfactant is added subsequent to the other components having been spray-dried or otherwise mixed together at high temperatures.

| | Phosphate Formula (%) | Non-Phosphate Formula (%) |
|---|---|---|
| Spray Dried Base | | |
| Sodium sulfate | 46.0 | 40.0 |
| Sodium tripolyphosphate | 29.0 | — |
| Sodium carbonate | — | 35.0 |
| Sodium silicate (1:2.4 ratio, $Na_2O/SiO_2$) | 4.28 | 10.4 |
| Water (36% slurry moisture) | 9.3 | 3.5 |
| Sodium hydroxide | — | 0.6 |
| Sodium coconut oil soap | 1.0 | 1.0 |
| Hydroxypropyl methyl cellulose (Methocel E-4M) | 0.075 | 0.075 |
| Fluorescent brighteners | 0.098 | 0.098 |
| Miscellaneous | 0.327 | 0.327 |
| Post-Dose | | |
| Alfonic 1218-70L | 8.93 | 9.0 |

EXAMPLES 2-5

Examples 2 through 5 illustrate detergent compositions that can be prepared by the new process which significantly reduces tower smoking problems. The components are mixed in an aqueous slurry (30% water). Subsequently, the compositions are spray-dried to produce a free-flowing powder.

| Component | Example 2 | Example 3 | Example 4 | Example 5 |
|---|---|---|---|---|
| Sodium sulfate | 30.0 | 42.0 | 50.0 | 30.0 |
| Sodium tripolyphosphate | — | 40.0 | 18.4 | 12.5 |
| Sodium carbonate | 26.0 | 10.0 | 20.0 | 40.0 |
| Sodium silicate | 35.0 | — | 2.0 | — |
| Alfonic 1214-70L | 7.0 | — | — | — |
| Alfonic 1412-70L | — | 7.0 | — | — |
| Alfonic 1218-70L | — | — | 7.0 | 15.0 |
| Sodium Coconut Soap | 1.0 | 1.0 | 0.10 | 1.5 |
| Hydroxypropyl methyl cellulose | 0.05 | — | 0.05 | 1.0 |
| Methyl cellulose | — | 0.10 | — | — |
| Diatomaceous Earth | 1.0 | — | 2.5 | — |
| Detergent Adjunct Materials | 0.05 | 0.05 | 0.05 | 0.05 |

EXAMPLE 6

Soil shield tests were conducted with 0, 3, and 5 prewashes using dirty motor oil as a soil on both 65/35 cotton/dacron (C/D) and 100% single knit (S/K) polyester. Except for the interchange of the Alfonic surfactant, the phosphorus and non-phosphorus formulations of Example 1 were employed for the following soil shield tests. Soil shield results are listed in Table III below. These evaluations were performed with a Terg-o-Tometer apparatus operated at 130° F. containing 180 ppm of hardness in the water. Detergent usage was at 1.99 grams per liter of water.

Formulations using the narrow E.O. ethoxylate exhibited a better soil shield effect in both the cotton/dacron and 100% polyester fabrics. For instance, after five prewashed cycles, the percent soil removal with Alfonic 1218-70L was 19.5 and 77.3 on the blend and 100% polyester fabric, respectively. In contrast, under the same conditions, Alfonic 1218-70 exhibited only a 12.8 and 43.3% soil removal on the blend and 100% polyester fabric, respectively.

For the non-phosphate containing detergent compositions, soil shield was also better with Alfonic 1218-70L than with the conventional Alfonic 1218-70. After three prewashes, the detergent formulation containing nonionic "L" displayed a 14.5 and 75.1% soil removal in contrast to the conventional Alfonic having 11.6 and 32.5% soil removal on the blend and 100% polyester fabric, respectively. Soil removal differences narrowed somewhat after five prewashes for the polyester fabric although the "L" nonionic was still superior.

TABLE III

Terg-O-Tometer Soil Shield Tests

| | | % Soil Removal | | | | | |
|---|---|---|---|---|---|---|---|
| | | C/D, 65/35 # Prewashes | | | S/K Polyester # Prewashes | | |
| Formula | Nonionic Type | 0 | 3 | 5 | 0 | 3 | 5 |
| Non-phosphate | Alfonic 1218-70 | 9.1 | 11.6 | 13.9 | 3.2 | 32.5 | 72.8 |
| Non-phosphate | Alfonic 1218-70L | 10.9 | 14.5 | 17.3 | 3.3 | 75.1 | 78.2 |
| Phosphate | Alfonic 1218-70 | 9.3 | 10.0 | 12.8 | 3.4 | 16.6 | 43.3 |
| Phosphate | Alfonic 1218-70L | 10.7 | 13.7 | 19.5 | 2.8 | 64.3 | 77.3 |

EXAMPLE 7

Further illustrations of the soil shield effects with the detergent compositions of the present invention are outlined in Table IV. Phosphorus and non-phosphorus detergent compositions as set forth in Example 1 were used for the washing sequences in Table IV. The only differences in the detergent formulations were changes in the identity of the nonionic surfactant. Alfonic 1218-70 was compared to the Alfonics 1218-70L, 1214-70L and 1412-70L. Terg-o-Tometer soil shield tests measuring the performance of these formulations were conducted at 120° F. Cloths were examined after 0, 3 and 5 wash cycles. Two types of cloths, one 65/35 polyester/cotton and the other 100% polyester were evaluated using dirty motor oil as the soil material.

From the results in Table IV, it is clear that the phosphorus formulations containing the ethoxylates with narrower ethylene oxide distribution were substantially more effective than those containing the conventional Alfonic 1218-70 under circumstances where polyester cloths have undergone five prewashes. Specifically, soil removals of 77.7%, 21.7% and 76.7% were obtained with the various Alfonic "L" surfactants compared with the 6.9% for conventional Alfonic ethoxylate. Smaller differences were seen between the conventional ethoxylate and those of the present inventionin regard to 65/35 cotton/polyester blends and with fewer prewash cycles, although significant soil removal differences existed even there.

TABLE IV

| Terg-O-Tometer Soil Shield Tests at 120° F. | | | | | | | |
|---|---|---|---|---|---|---|---|
| | | % Soil Removal (# prewashes) | | | | | |
| Formula | | 0 | | 3 | | 5 | |
| Type | Nonionic | 65/35 | Poly | 65/35 | Poly | 65/35 | Poly |
| Non-Phosphate | Alfonic 1218-70 | 9.0 | 3.2 | 8.9 | 4.3 | 7.5 | 2.4 |
| Non-Phosphate | Alfonic 1214-70L | 10.8 | 2.7 | 13.0 | 51.9 | 13.3 | 60.9 |
| Non-Phosphate | Alfonic 1412-70L | 11.1 | 3.2 | 13.5 | 26.5 | 14.1 | 32.9 |
| Phosphate | Alfonic 1218-70 | 7.8 | −0.3 | 11.3 | 3.4 | 11.1 | 6.9 |
| Phosphate | Alfonic 1218-70L | 10.3 | −0.9 | 16.4 | 25.1 | 19.0 | 77.7 |
| Phosphate | Alfonic 1214-70L | 7.7 | −1.8 | 12.9 | 6.0 | 12.9 | 21.7 |
| Phosphate | Alfonic 1412-70L | 12.8 | −1.7 | 17.4 | 48.9 | 19.5 | 76.7 |

EXAMPLE 8

Another important aspect of the detergent compositions of this invention is their contribution to meeting environmental restrictions regarding smoke emission during the detergent manufacturing process. Smoke point data has been collected in the laboratory on the conventional ethoxylate alcohol (e.g. Alfonic 1218-70) and compared to the narrow E.O. distribution ethoxylates of the present invention (e.g. Alfonic "L" series). A summary of the smoke point data is shown in the following table. Alfonic 1218-70 has a smoke point of 282° F. whereas that of the new Alfonic "L" series have smoke points of 321° F. or higher.

The procedure used to determine the smoke point was the AOCS (American Oil Chemist Society) 9a-48 Modified. The apparatus needed consists of a cabinet with a 100 watt bulb painted black inside, a 3" immersible thermometer 30°–700° F., an electric heater and a Cleveland cup. The Cleveland cup is filled with nonionic so that the top of the meniscus is exactly at the filling line. The position of the apparatus is adjusted so that the beam of light is directed across the center of the cup. The thermometer is suspended in a vertical position in the center of the cup. The electric heater is then set so that the temperature of the nonionic sample increases at a rate of 7°–10° F. per minute. The smoke point is the temperature indicated by the thermometer when the sample gives off a thin continuous stream of smoke.

TABLE V

| Smoke Point Data and Manufacturing Experience | | |
|---|---|---|
| Alcohol Ethoxylate | Smoke Point (°F.) | Tower Smoke Problem |
| Alfonic 1218-70 | 282 | Yes |
| Alfonic 1218-70L | 321 | No |
| Alfonic 1412-70L | 321 | No |
| Alfonic 1214-70L | 323 | Not tested |

In the process for preparing low smoking detergent compositions, the narrow ethylene oxide distributed ethoxylated $C_{12-18}$ fatty alcohols (e.g. Alfonic 1218-70L), modified cellulose ether, soap, detergent builders and the minor components were slurried with water in a crutcher. Subsequently, the said slurry was sprayed under pressure through a spray tower using heated air to dry the slurry. A detergent powder was thereby formed.

Plant testing has confirmed the results of the laboratory smoke data. Detergent compositions of the present invention were prepared on a plant scale by the spray drying technique. With Alfonic 1412-70L, the spray tower exhaust, monitored by qualified plant observers, was rated at 25% opacity, which was significantly lower than the marginally acceptable 40% opacity obtained from the conventional Alfonic 1218-70. Identical detergent formulations, other than nonionic, were used in both experiments.

Grain loading tests were also conducted to measure and identify train solids and organic emissions from the tower stack. The narrow E.O. distributed ethoxylate provided lower filter and probe emissions, organic wet train material emissions and percent of total allowable emissions than the conventional ethoxylate. The following grain loading test values were obtained.

| | Alfonic 1218-70 (Control) | Alfonic 1412-70L |
|---|---|---|
| Filter and Probe, lbs/hour* | 9.90 | 8.60 |
| Organic and Wet Train Material, lbs/hour* | 12.95 | 4.40 |

-continued

| | Alfonic 1218-70 (Control) | Alfonic 1412-70L |
|---|---|---|
| % Allowable Emissions | 22.04 | 19.28 |

*Ref. Federal Register, Vol. 36, No. 234 [Be] and 247.

The foregoing description and examples illustrate selected embodiments of the present invention and in light thereof variations and modifications will be suggested to one skilled in the art, all of which are within the spirit and purview of this invention.

What is claimed is:

1. A process for the spray-dry manufacture of a detergent composition wherein tower smoke is reduced comprising:

(i) forming an azueous mixture containing:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution characterized in that at least 70% by weight of the surfactant contains polyethoxy groups which are within about 3 ethoxy groups of the average number of ethylene oxide units and that less than 5% of the ethoxylate mixture comprises 6 or less ethylene oxide molecules per alcohol molecule further characterized by exhibiting a smoke point of 321° F. or higher;

(b) an effective amount to impart a soil shield up to about 1.0% of a modified cellulose ether selected from the group consisting of alkyl cellulose, hydroxyalkyl cellulose, hydroxyalkyl alkyl cellulose ethers and mixtures thereof;

(c) the balance, detergency adjunct materials; and (ii) spray drying said mixture to produce a detergent powder.

2. A method for imparting a soil shield to semi-synthetic and synthetic fabrics comprising washing said fabrics three or more times with a detergent composition comprising:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution characterized in that at least 70% by weight of the surfactant contains polyethoxy groups which are within about 3 ethoxy groups of the average number of ethylene oxide units and that less than 5% of the ethoxylate mixture comprises 6 or less ethylene oxide molecules per alcohol molecule;

(b) an effective amount to impart a soil shield up to about 1.0% of a modified cellulose ether selected from the group consisting of alkyl cellulose, hydroxyalkyl cellulose, hydroxyalkyl alkyl cellulose ethers and mixtures thereof; and (c) the balance, detergency adjunct materials.

3. A method for imparting a soil shield to semi-synthetic and synthetic fabrics comprising washing said fabrics three or more times with a detergent composition comprising:

(a) about 7 to about 15% by weight of a nonionic surfactant formed from $C_{12-18}$ fatty alcohols ethoxylated with about 10 to about 14 moles of ethylene oxide and containing a narrow ethylene oxide distribution characterized in that at least 70% by weight of the surfactant contains polyethoxy groups which are within about 3 ethoxy groups of the average number of ethylene oxide units and that less than 5% of the ethoxylate mixture comprises 6 or less ethylene oxide molecules per alcohol molecule;

(b) an effective amount to impart a soil shield up to about 1.0% of a modified cellulose ether selected from the group consisting of alkyl cellulose, hydroxyalkyl cellulose, hydroxyalkyl alkyl cellulose ethers and mixtures thereof; and (c) about 0 to about 1.5% of a soap derived from water-soluble sodium or potassium salts of $C_{10-20}$ fatty acids;

(d) about 2–35% of sodium silicate;

(e) about 30–50% of sodium sulfate; and (f) about 10–40% of sodium carbonate or sodium tripolyphosphate or mixtures thereof.

* * * * *